US011231005B2

(12) United States Patent
Dallal et al.

(10) Patent No.: US 11,231,005 B2
(45) Date of Patent: Jan. 25, 2022

(54) STARTER MOTOR TEMPERATURE INDICATION SYSTEMS

(71) Applicant: DENSO International America, Inc., Southfield, MI (US)

(72) Inventors: Fouad Rachid Dallal, Dearborn Heights, MI (US); Joe Lubinski, South Lyon, MI (US); Landen Green, Farmington Hills, MI (US); Trevor Adam Rowe, Sterling Heights, MI (US); Ilco Aksovski, Macomb, MI (US); Tadakazu Nagata, Novi, MI (US)

(73) Assignee: DENSO INTERNATIONAL AMERICA, INC., Southfield, MI (US)

( * ) Notice: Subject to any disclaimer, the term of this patent is extended or adjusted under 35 U.S.C. 154(b) by 70 days.

(21) Appl. No.: 16/845,187

(22) Filed: Apr. 10, 2020

(65) Prior Publication Data

US 2021/0317810 A1 Oct. 14, 2021

(51) Int. Cl.
*F02N 11/08* (2006.01)
*F02N 11/10* (2006.01)

(52) U.S. Cl.
CPC ..... *F02N 11/0848* (2013.01); *F02N 11/087* (2013.01); *F02N 11/10* (2013.01); *F02N 2200/022* (2013.01); *F02N 2200/045* (2013.01); *F02N 2250/02* (2013.01); *F02N 2300/2011* (2013.01)

(58) Field of Classification Search
CPC ..... F02N 11/0848; F02N 11/087; F02N 2200/045; F02N 2300/2011; F02N 11/10; F02N 2250/02; F02N 2200/022
See application file for complete search history.

(56) References Cited

U.S. PATENT DOCUMENTS

2008/0264374 A1* 10/2008 Harris ..... E02F 9/20 123/179.3
2009/0241884 A1* 10/2009 Saitoh ..... F02N 11/087 123/179.4

FOREIGN PATENT DOCUMENTS

CN 110259618 A 9/2019
DE 102007030297 A1 1/2009
WO 2013191619 A1 12/2013

* cited by examiner

*Primary Examiner* — Sizo B Vilakazi
(74) *Attorney, Agent, or Firm* — Dickinson Wright PLLC

(57) ABSTRACT

An engine starter apparatus includes a starter motor, a temperature sensor configured to detect a temperature of the starter motor, a light source integrated with the starter motor, and a controller operatively connected to the temperature sensor and the light source. The controller is configured to illuminate the light source in a first color in response to the temperature of the starter motor exceeding a first temperature threshold. The controller is configured to illuminate the light source further in a second color in response to the temperature of the starter motor exceeding a second temperature threshold. The second temperature threshold is greater than the first temperature threshold. The first and second color are different. The second temperature threshold corresponds to a life limit of the starter motor. Illumination of the light source indicates an overheated starter motor, which may warrant a replacement of the starter motor.

16 Claims, 5 Drawing Sheets

STARTER MOTOR TEMPERATURE INDICATION SYSTEMS

TECHNICAL FIELD

The present disclosure relates to temperature indication systems, for example, temperature indication systems configured to indicate an overheated starter motor for an engine.

BACKGROUND

A vehicle engine normally operates in a temperature range of 180-200 degrees Fahrenheit (F). During operation, different components of the engine may reach different temperature levels based on locations and/or functions of the components related to the engine. An overheated engine may induce an adverse effect on the components. For example, components made of metals may deform or warp over time if operating at a high temperature level, which may consequently lead to engine poor performance and degradation. In addition, assessing an operating temperature of a component, such as a starter motor, including whether the operating temperature exceeds a normal temperature threshold, may be difficult when the engine is overheated.

SUMMARY

According to one embodiment, an engine starter apparatus is disclosed. The engine starter apparatus includes a starter motor, a temperature sensor configured to detect a temperature of the starter motor, a light source integrated with the starter motor, and a controller operatively connected to the temperature sensor and the light source. The controller is configured to illuminate the light source in response to the temperature of the starter motor exceeding a first temperature threshold. In addition, the controller is configured to illuminate the light source further in response to the temperature of the starter motor exceeding a second temperature threshold. The second temperature threshold may be greater than the first temperature threshold. The second temperature threshold may correspond to a life limit of the starter motor. The life limit may be a fixed threshold stored in memory that represents the maximum allowable temperature for the starter motor to properly operate. Specifically, the controller is configured to illuminate the light source in a first color in response to the temperature of the starter motor exceeding the first temperature threshold, and configured to illuminate the light source in a second color in response to the temperature of the starter motor exceeding the second temperature threshold. The second color is different from the first color. Further, the light source may be a light-emitting diode (LED). The controller may also include a memory configured to store the temperature of the starter motor. The controller may be wirelessly connected to a remote module configured to monitor and record the temperature of the starter motor.

According to another embodiment, a system for indicating an overheated engine starter is disclosed. The system may include a starter-motor housing, a starter motor within the starter-motor housing, and a non-reversible temperature indicator mounted to the starter-motor housing such that the temperature indicator is visible from an exterior of the starter-motor housing. The temperature indicator is configured to change states in response to the temperature of the starter motor exceeding a temperature threshold. The temperature indicator may include a substance configured to, but not limited to, melt, break apart, or deform in response to the temperature of the starter motor exceeding the temperature threshold.

According to yet another embodiment, an engine startup system is disclosed. The engine startup system includes a starter motor configured to crank an engine and be powered by an energy source, a starter relay operatively interposed between the energy source and the starter motor and configured to selectively deliver electrical power from the energy source to the starter motor, a solenoid coupled to the starter motor and configured to connect the starter motor to the energy source, a temperature sensor configured to detect a temperature of the starter motor, a light source integrated with the starter motor, and a controller operatively connected to the temperature sensor and the light source. The energy source may be a battery assembly. The controller is configured to illuminate the light source in response to the temperature of the starter motor exceeding a first temperature threshold. In addition, the controller is configured to illuminate the light source further in response to the temperature of the starter motor exceeding a second temperature threshold. The second temperature threshold is greater than the first temperature threshold. The second temperature threshold may correspond to a life limit of the starter motor. The life limit may be a fixed threshold stored in memory that represents the maximum allowable temperature for the starter motor to properly operate. Specifically, the controller is configured to illuminate the light source in a first color in response to the temperature of the starter motor exceeding the first temperature threshold, and configured to illuminate the light source in a second color in response to the temperature of the starter motor exceeding the second temperature threshold. The second color is different from the first color. Further, the light source may be a light-emitting diode (LED). The controller may also include a memory configured to store the temperature of the starter motor. The controller may be wirelessly connected to a remote module configured to monitor and record the temperature of the starter motor.

DETAILED DESCRIPTION

Figure 1:
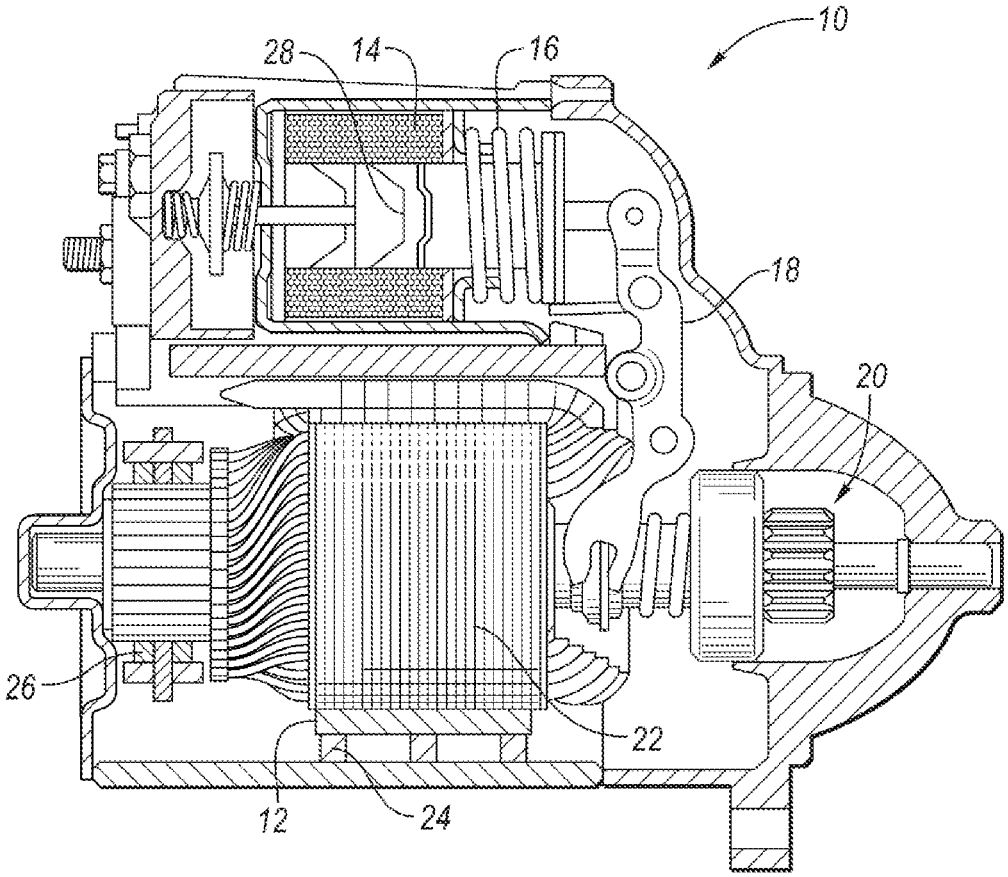
FIG. 1 depicts a sectional view of a starter motor.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

This disclosure should not be limited to the specific embodiments and methods described below, as specific components and/or conditions may, of course, vary. Furthermore, the terminology used herein is used only for the purpose of describing embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Reference is being made in detail to compositions, embodiments, and methods of embodiments known to the inventors. However, it should be understood that disclosed embodiments are merely exemplary, and the scope of the disclosure may be embodied in various and alternative forms. Therefore, specific details disclosed herein are not to be interpreted as limiting, rather merely as representative bases for teaching one skilled in the art to variously employ the present invention.

Starter motors are devices for initiating operation of an engine such as those used in vehicles. The function of a starter motor is important to the operation of a vehicle. An overheated starter motor may shorten an operational life of the starter motor and may consequently damage the performance of the vehicle. Upon the starter motor being overheated, the vehicle typically generates a sound alarm or "check engine" notification to notify a user that something may be wrong with the engine. However, the user may often ignore such an alarm. In addition, these alarms do not indicate much, if any, information about the starter motor (as opposed to other engine components) to the user. For example, the user may not be able to know whether the starter motor has simply been overheated or has approached a life limit such that a replacement of the starter motor is required. Therefore, there is a need to indicate the temperature of the starter motor in a more visually efficient manner.

Aspects of the present disclosure are directed to the incorporation of a light source or a heat-sensitive substance into a housing of a starter motor to visually indicate an overheated starter motor to a user. In one embodiment, an engine starter apparatus may include a light source, such as a light-emitting diode (LED), which may illuminate in response to the temperature of the starter motor exceeding a temperature threshold. In another embodiment, the light source may illuminate different colors to signify different temperature levels of the starter motor. For example, the light source may illuminate an amber color in response to the temperature of the starter motor exceeding a temperature threshold. The light source may further illuminate a red color if the temperature of the starter motor has exceeded the temperature threshold after a certain amount of time. The red color of the light source may indicate that the starter motor has approached its life limit, which may warrant to replace the starter motor. In yet another embodiment, a non-resettable temperature indicator having a heat-sensitive substance may be mounted to the housing of the starter motor and configured to change states, including, but not limited to, melting, breaking apart, or deformation, in response to the temperature of the starter motor exceeding a temperature threshold.

FIG. 1 depicts a sectional view of a starter motor 10. As shown in FIG. 1, the starter motor 10 may include an electric motor 12, a solenoid 14, a return spring 16, a shift fork 18, and a starter drive gear 20. The electric motor 12 further includes an armature 22, field coils 24, and a brush 26. Additionally, the solenoid 14 includes a plunger 28 there within. Specifically, the solenoid 14 may include coils, which can act as a magnet when current flows there through. The solenoid 14 may be used as a switch or control for the starter motor 10. The return spring 16 may apply mechanical pressure on the plunger 28 to force the plunger 28 back to its rest position. The shift fork 18 may be a mechanical link used to push the starter drive gear 20 to engage engine flywheel gears for engine cranking. The armature 22 is a rotating part of the starter motor 10, which may experience a torque and start rotating upon supplied with current. The field coils 24 are electromagnets used to generate a magnetic field in the starter motor 10. The brush 26 may relay current from an external circuit to the armature 22 and may be made from carbon or graphite. The plunger 28 may act as a connecting rod to the shift fork 18.

Figure 2:
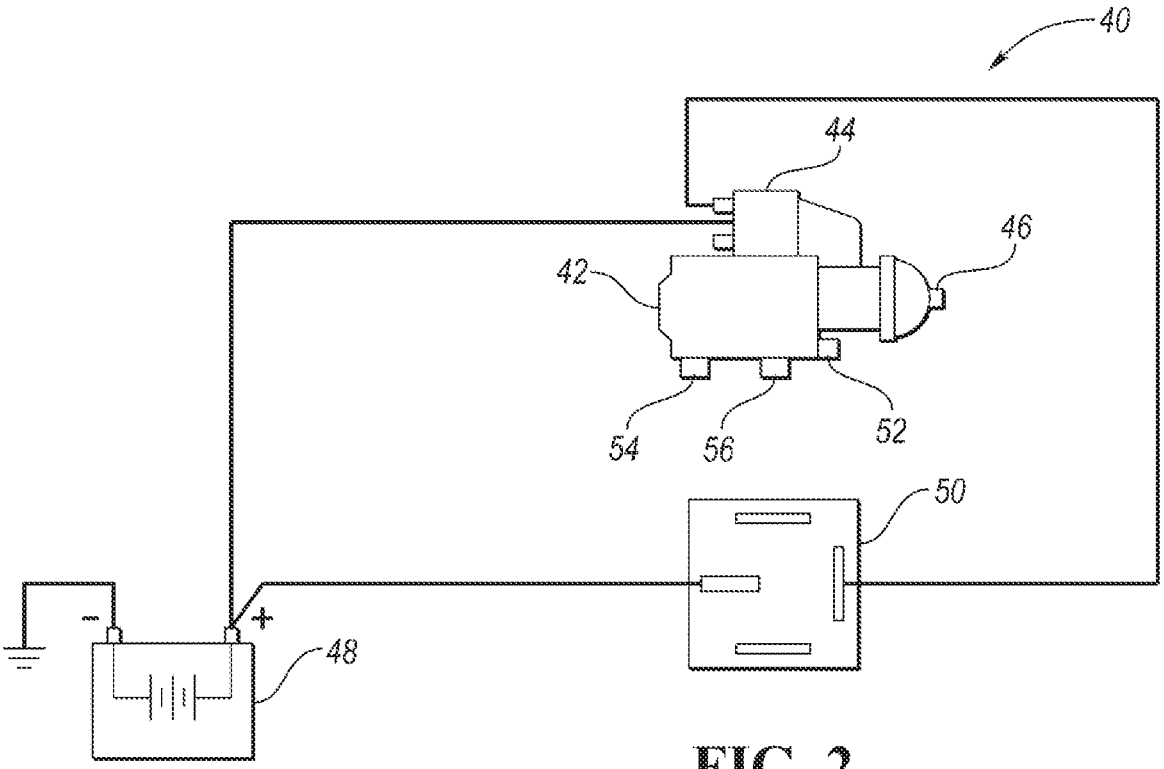
FIG. 2 depicts a circuit diagram showing one embodiment of an architecture of an engine startup system.

FIG. 2 depicts a circuit diagram showing one embodiment of an architecture of an engine startup system 40. As illustrated in FIG. 2, the engine startup system 40 includes a starter motor (e.g., the starter motor 10 described above) enclosed within a starter-motor housing 42. The engine startup system 40 also includes a solenoid 44 coupled to the starter-motor housing 42, a "Start/Stop" ignition button 46 integrated with the starter-motor housing 42, an energy source 48, and a starter relay 50 operatively interposed between the energy source 48 and the starter-motor housing 42. Specifically, the energy source 48 may be a battery assembly configured to provide electrical power to the starter motor. The solenoid 44 is configured to connect the housing 42 of the starter motor to the energy source 48. Further, the starter relay 50 may selectively deliver electrical power from the energy source 48 to the starter motor.

In order to provide a visual indication of a temperature of the starter motor, a light source 52, such as a light-emitting diode (LED), may be integrated with the housing 42 of the starter motor, as depicted in FIG. 2. The light source 52 may be powered by the energy source 48. In one embodiment, the light source 52 may be mounted to an exterior of the starter-motor housing 42 such that the light source 52 is visible from the exterior of the starter-motor housing 42. In another embodiment, the light source 52 may be positioned at or adjacent the "Start/Stop" ignition button 46. In yet another embodiment, the light source 52 may be located on a dashboard or a speedometer of a vehicle.

The engine startup system 40 may also include a temperature sensor 54 configured to detect a temperature of the starter motor. As shown in FIG. 2, the temperature sensor 54 may be mounted to an exterior of the starter-motor housing 42. However, the temperature sensor 54 may also be mounted to an interior of the starter-motor housing 42.

The engine startup system 40 may further include an electric control unit (ECU). The ECU may more generally be referred to as a controller 56, which can be any controller capable of receiving information from the temperature sensor 54, processing the information, and outputting instructions to illuminate the light source 52, for example.

In this disclosure, the terms "controller" and "system" may refer to, be part of, or include processor hardware (shared, dedicated, or group) that executes code and memory hardware (shared, dedicated, or group) that stores code executed by the processor hardware. The code is configured to provide the features of the controller and systems described herein. In one example, the controller may include a processor, memory, and non-volatile storage. The processor may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on computer-executable instructions residing in memory. The memory may include a single memory device or a plurality of memory devices including, but not limited to, random access memory ("RAM"), volatile memory, non-volatile memory, static random-access memory ("SRAM"), dynamic random-access memory ("DRAM"), flash memory, cache memory, or any other device capable of storing information. The non-volatile storage may include one or more persistent data storage devices such as a hard drive, optical drive, tape drive, non-volatile solid-state device, or any other device capable of persistently storing information. The processor may be configured to read into memory and execute computer-executable instructions embodying one or more software programs residing in the non-volatile storage. Programs residing in the non-volatile storage may include or be part of an operating system or an application, and may be compiled or interpreted from computer programs created using a variety of programming languages and/or technologies, including, without limitation, and either alone or in combination, Java, C, C++, C #, Objective C, Fortran, Pascal, Java Script, Python, Perl, and PL/SQL. The computer-executable instructions of the programs may be configured, upon execution by the processor, to illuminate the light source based on the temperature of the starter motor, for example.

Implementations of the subject matter and the operations described in this specification can be implemented in digital electronic circuitry, or in computer software embodied on a tangible medium, firmware, or hardware, including the structures disclosed in this specification and their structural equivalents, or in combinations of one or more of them. Implementations of the subject matter described in this specification can be implemented as one or more computer programs embodied on a tangible medium, i.e., one or more modules of computer program instructions, encoded on one or more computer storage media for execution by, or to control the operation of, a data processing apparatus. A computer storage medium can be, or be included in, a computer-readable storage device, a computer-readable storage substrate, a random or serial access memory array or device, or a combination of one or more of them. The computer storage medium can also be, or be included in, one or more separate components or media (e.g., multiple CDs, disks, or other storage devices). The computer storage medium may be tangible and non-transitory.

A computer program (also known as a program, software, software application, script, or code) can be written in any form of programming language, including compiled languages, interpreted languages, declarative languages, and procedural languages, and the computer program can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, libraries, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, such as a field programmable gate array ("FPGA") or an application specific integrated circuit ("ASIC"). Such a special purpose circuit may be referred to as a computer processor even if it is not a general-purpose processor.

Referring to FIG. 2, the controller 56 may be operatively connected to the temperature sensor 54 and the light source 52. In one embodiment, the controller 56 may be mounted to an exterior of the starter-motor housing 42. In another embodiment, the controller 56 may be mounted to an interior of the starter-motor housing 42. In yet another embodiment, the controller 56 may be situated at other locations of a vehicle, such as on a dashboard or a speedometer. The controller 56 may also be part of, or in communication with, other controllers in the vehicle, such as an engine control unit.

In one embodiment, the controller 56 may trigger an illumination event of the light source 52 when the temperature of the starter motor is detected to have exceeded a first temperature threshold ($T_{thresh_1}$), as indicated by the temperature sensor 54. Because the light source 52 is powered by the energy source 48, the light source 52 may remain illuminated once triggered by the controller 56, unless the light source 52 is disconnected from the energy source 48 or the energy source 48 runs out of power. In other words, the illumination of the light source 52 may be a non-resettable process.

In another embodiment, the controller 56 is configured to illuminate the light source 52 further in response to the temperature of the starter motor exceeding a second temperature threshold ($T_{thresh_2}$). The second temperature threshold ($T_{thresh_2}$) is greater than the first temperature threshold ($T_{thresh_1}$). For example, the controller 56 may trigger the light source 52 to illuminate a first color (e.g., amber) in response to the temperature of the starter motor exceeding the first temperature threshold ($T_{thresh_1}$), and may further trigger the light source 52 to illuminate a second color (e.g., red) in response to the temperature of the starter motor exceeding the second temperature threshold ($T_{thresh_2}$). The second temperature threshold ($T_{thresh_2}$) corresponds to a life limit of the starter motor. In other words, the second temperature threshold ($T_{thresh_2}$) may be a fixed threshold stored in memory that represents the maximum allowable temperature for the starter motor to properly operate. Therefore, the illumination of the second color by the light source 52 may indicate to a user that the starter motor has approached its life limit such that a replacement of the starter motor is necessary.

The first and second temperature thresholds, $T_{thresh_1}$ and $T_{thresh_2}$, may be dependent on a specific design of the starter motor, including, but not limited to, a material used for manufacturing the starter motor or a class of winding insulation of the starter motor. As such, the first and second temperature thresholds may not be influenced by factors such as vehicle conditions, ambient temperatures or vehicle models.

In one non-limiting example, the first temperature threshold ($T_{thresh_1}$) can be 170 degrees Celsius (C), and the second temperature threshold ($T_{thresh_2}$) can be 180 degrees Celsius (C).

Apart from illumination, the light source 52 may also operate in other modes to indicate the temperature of the starter motor. For example, the light source 52 may, but not limited to, blink, flash, or pulse upon triggered by the controller 56. In addition, the engine startup system 40 may include one or more light sources to indicate the temperature of the starter motor.

The controller 56 may further comprise a memory configured to store the temperature of the starter motor. The memory may include information such as pre-programmed lookup tables of safety temperature limits for starter motors. In operation, the controller 56 can compare the temperature of the starter motor with the safety temperature limits to determine whether the starter motor has been overheated or has approached a life limit.

The controller 56 may be wirelessly connected to a remote module, including, but not limited to, a mobile device (e.g., a smartphone), a digital assistant (e.g., Apple's Siri, Amazon's Alexa or Microsoft's Cortana), a backend server of an original equipment manufacturer (OEM). For example, upon detecting an overheated starter motor, the controller 56 may transmit a message to the remote module to alert of the temperature of the starter motor. This may also allow an owner of a vehicle to be timely warned of an overheated condition of the starter motor even when the owner is not the one operating the vehicle. In addition, sharing the temperature of the starter motor with an OEM may facilitate the OEM to monitor the functionality of the starter motor. This may additionally allow the OEM to evaluate an effectiveness of a starter motor design or even modify the starter motor design to improve the life limit of a starter motor.

Apart from incorporating a light source with a starter motor, a heat-sensitive substance may also be integrated with the starter motor for a visual temperature indication. The heat-sensitive substance may be susceptible to physical and/or chemical state changes when the temperature of the starter motor is high. For example, the heat-sensitive substance may melt, break apart, or deform in response to a temperature of the starter motor exceeding the first and/or second temperature threshold. In one embodiment, the heat-sensitive substance may be a thermoplastic.

Figure 3:
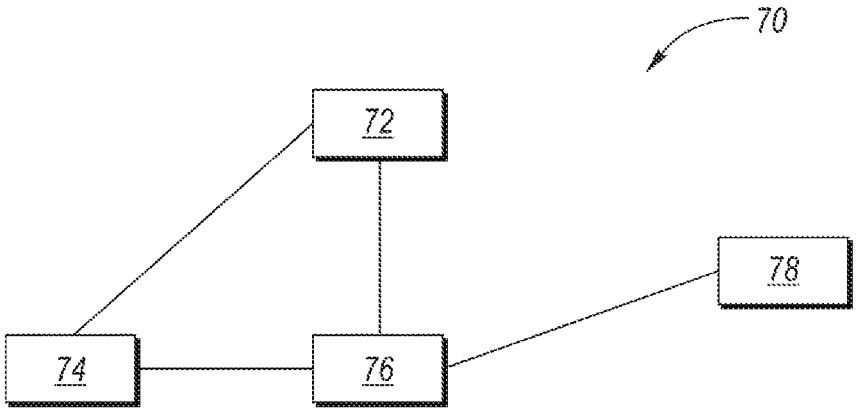
FIG. 3 depicts a schematic diagram of an engine starter apparatus in accordance with the engine startup system described in FIG. 2.

FIG. 3 depicts a schematic diagram of an engine starter apparatus in accordance with the engine startup system described in FIG. 2. As shown in FIG. 3, the engine starter apparatus 70 includes a starter motor 72, a temperature sensor 74, a controller 76, and a light source 78.

The temperature sensor 74 may detect a temperature of the starter motor 72. The light source 78 may be an LED and may be mounted to an exterior of a housing of the starter motor 72. The light source 78 may also be positioned at other locations in a vehicle, including, but not limited to, at or near a "Start/Stop" ignition button, a dashboard, or a speedometer of the vehicle.

Referring to FIG. 3, the controller 76 may be operatively connected to the temperature sensor 74 and the light source 78. The controller 76 may include a memory configured to store the temperature of the starter motor 72. The controller 76 is configured to illuminate the light source 78 in response to the temperature of the starter motor exceeding a first temperature threshold ($T_{thresh_1}$). In addition, the controller 76 is configured to illuminate the light source 78 further in response to the temperature of the starter motor 72 exceeding a second temperature threshold ($T_{thresh_2}$). The second temperature threshold is greater than the first temperature threshold. The second temperature threshold may correspond to a life limit of the starter motor 72. The life limit may be a fixed threshold stored in memory that represents the maximum allowable temperature for the starter motor 72 to properly operate.

In one embodiment, the controller 76 may be wirelessly connected to a remote module, including, but not limited to, a mobile device (e.g., a smartphone), a digital assistant (e.g., Apple's Siri, Amazon's Alexa or Microsoft's Cortana), a backend server of an original equipment manufacturer (OEM).

Figure 4:
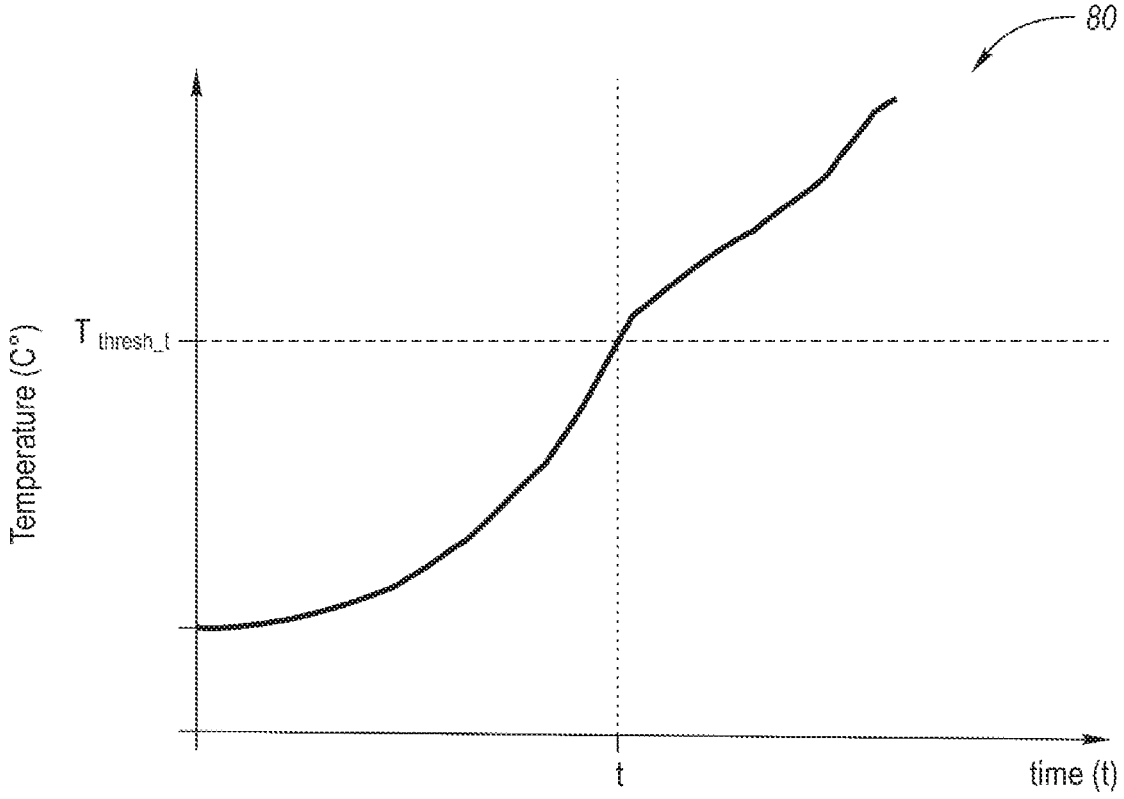
FIG. 4 depicts a graph illustrating one embodiment of a temperature of a starter motor as a function of time.

FIG. 4 depicts a graph 80 illustrating one embodiment of a temperature of a starter motor as a function of time. In accordance with the engine startup system described in FIG. 2, if the temperature of the starter motor exceeds a temperature threshold ($T_{thresh_t}$), the controller 56 is configured to illuminate the light source 52. The temperature threshold ($T_{thresh_t}$) may be pre-programmed into memory and accessed by the controller 56. As shown in FIG. 4, the temperature threshold ($T_{thresh_t}$) corresponds to a time t. The light source 52 at this stage may illuminate a color (e.g., amber or red). If the temperature of the starter motor keeps increasing after the time t, the light source 52 may stay illuminating until the light source 52 is disconnected from the energy source 48 of the engine startup system 40 or the energy source 48 runs out of power. Therefore, the illumination of the light source 52, once triggered by the controller 56, is a non-resettable process.

Figure 5:
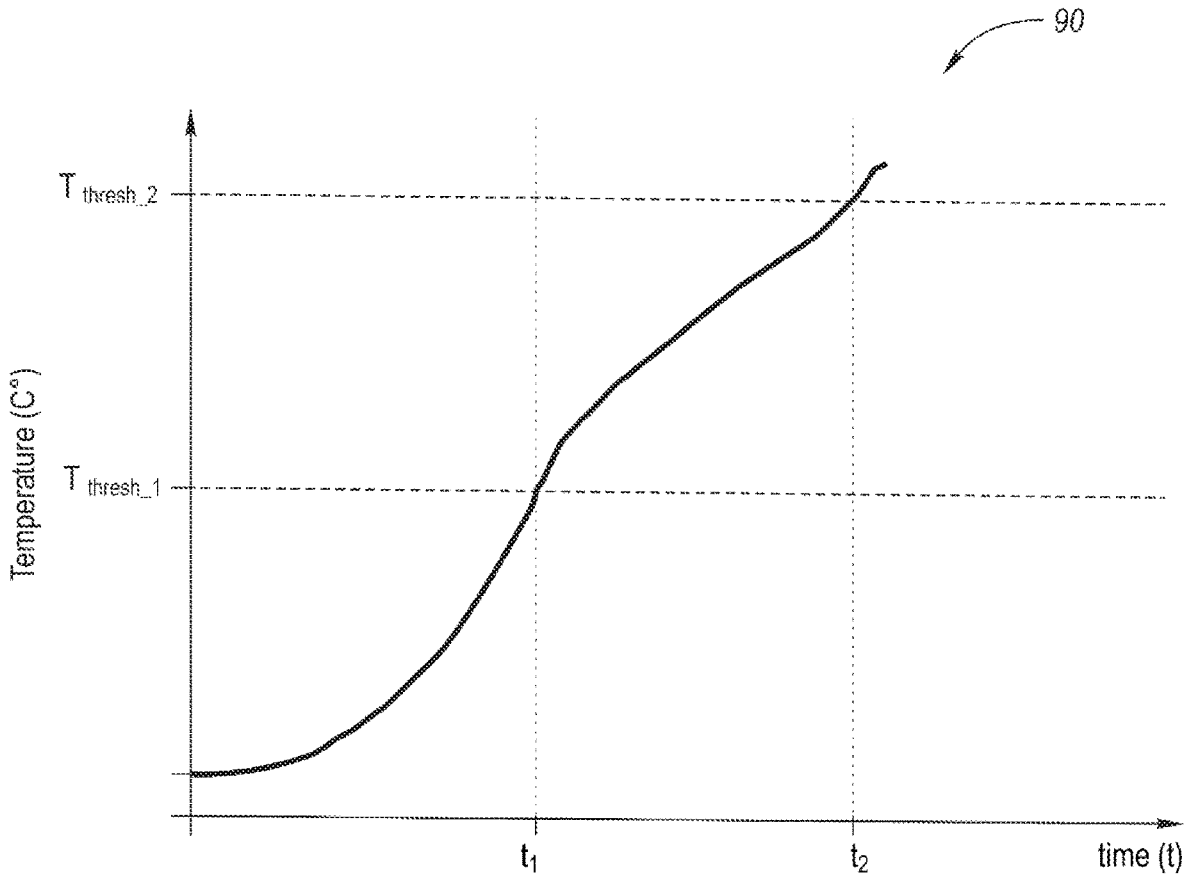
FIG. 5 depicts a graph illustrating another embodiment of a temperature of a starter motor as a function of time.

FIG. 5 depicts a graph 90 illustrating another embodiment of a temperature of a starter motor as a function of time. Still in accordance with the engine startup system 40 described in FIG. 2, the controller 56 is configured to illuminate the light source 52 in response to the temperature of the starter motor exceeding a first temperature threshold ($T_{thresh_1}$). The first temperature threshold ($T_{thresh_1}$) may be pre-programmed into memory and accessed by the controller 56. As shown in FIG. 5, the first temperature threshold ($T_{thresh_1}$) corresponds to a time $t_1$. The light source 52 at this stage may illuminate in a first color (e.g., amber).

Still referring to FIG. 5, if the temperature of the starter motor keeps increasing after exceeding the first temperature threshold ($T_{thresh_1}$), but is below a second temperature threshold ($T_{thresh_2}$), the light source 52 may stay illuminating in the first color. However, once the temperature of the starter motor exceeding the second temperature threshold ($T_{thresh_2}$, the controller 56 is configured to illuminate the light source 52 in a second color (e.g., red). The second temperature threshold ($T_{thresh_2}$) may also be pre-programmed into memory and accessed by the controller 56. As shown in FIG. 5, the second temperature threshold ($T_{thresh_2}$) corresponds to a time $t_2$. In addition, the second temperature threshold ($T_{thresh_2}$) may correspond to a life limit of the starter motor. The life limit may be a fixed threshold that represents the maximum allowable temperature for the starter motor to properly operate. Therefore, by illuminating the second color, the light source 52 can indicate to a user that the starter motor has approached its life limit, warranting a replacement of the starter motor.

Figure 6:
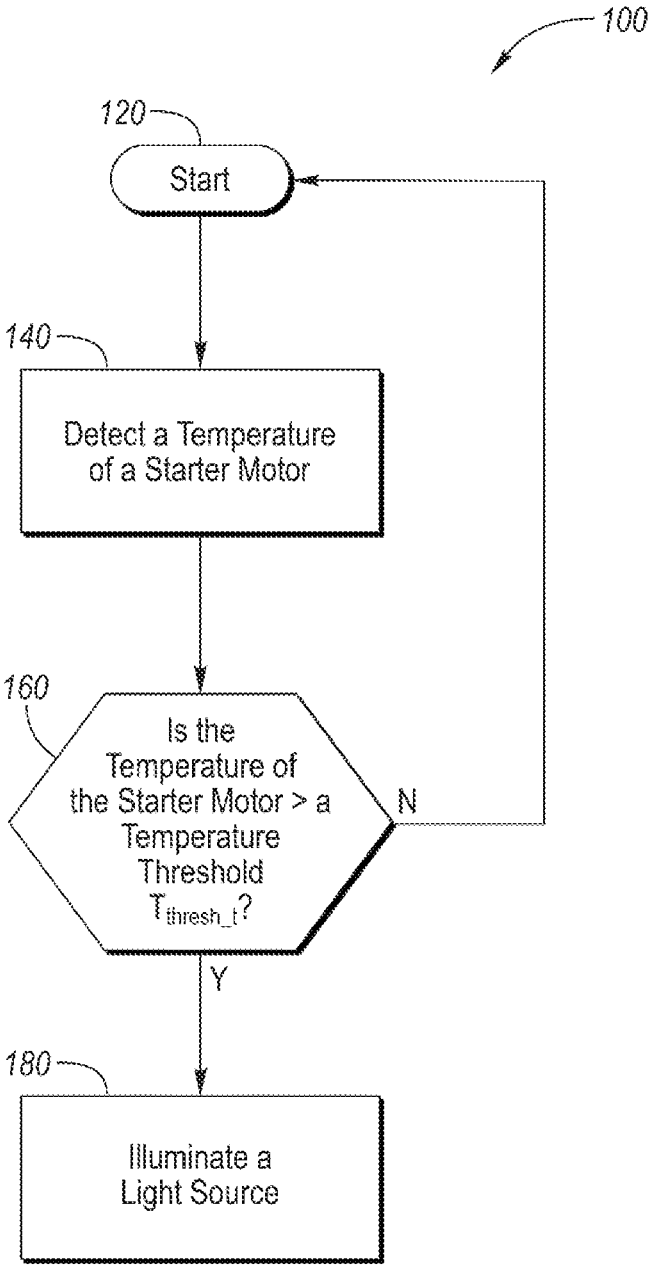
FIG. 6 depicts an exemplary block diagram illustrating one embodiment of a temperature indication system for a starter motor.

FIG. 6 depicts an exemplary block diagram 100 illustrating one embodiment of a temperature indication system for a starter motor. Referring to FIG. 6, at step 120, an engine is ignited by the engine startup system 40 described in FIG. 2. At step 140, a temperature sensor detects a temperature of the starter motor. At step 160, if the temperature of the starter motor exceeds a temperature threshold ($T_{thresh_t}$), a controller triggers an illumination event of a light source at step 180. However, if the temperature of the starter motor does not exceed the temperature threshold ($T_{thresh_t}$), the light source remains off. Therefore, when seeing the light source illuminating, a user would know that the starter motor has been overheated.

Figure 7:
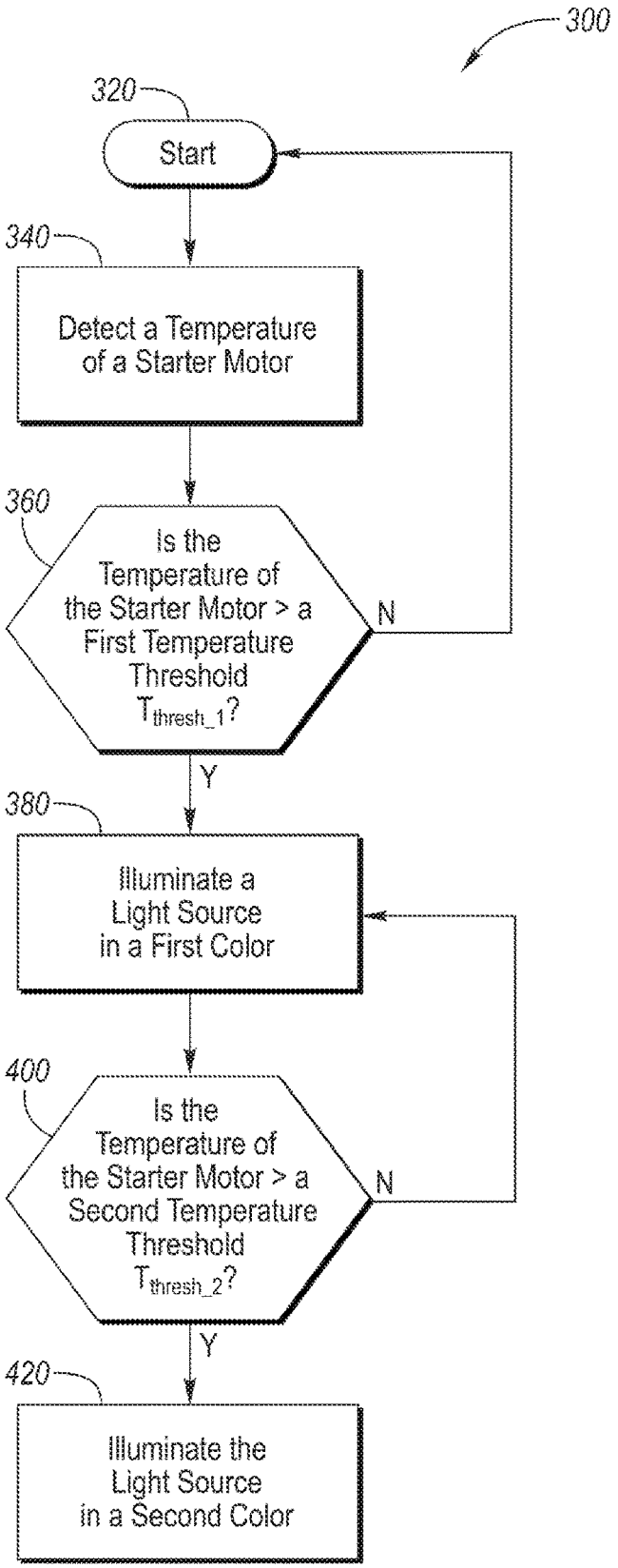
FIG. 7 depicts an exemplary block diagram illustrating another embodiment of a temperature indication system for a starter motor.

FIG. 7 depicts an exemplary block diagram 300 illustrating another embodiment of a temperature indication system for a starter motor. Referring to FIG. 7, at step 320, an engine is ignited by the engine startup system 40 described in FIG. 2. At step 340, a temperature sensor detects a temperature of the starter motor. At step 360, if the temperature of the starter motor exceeds a first temperature threshold ($T_{thresh_1}$), a controller triggers an illumination event of a light source in a first color at step 380. However, if the temperature of the starter motor does not exceed the first temperature threshold ($T_{thresh_1}$), the light source remains off. The illumination of the light source in the first color thus indicates to a user that the starter motor has been overheated.

Following step 380, if the temperature of the starter motor further exceeds a second temperature threshold ($T_{thresh_2}$) at step 400, the controller is configured to illuminate the light source in a second color at step 420. However, if the temperature of the starter motor does not exceed the second temperature threshold ($T_{thresh_2}$), the light source remains illuminating in the first color. When seeing the light source illuminating in the second color, a user would know that the starter motor has approached its life limit. As such, the user would go to a dealership to have the starter motor replaced.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. An engine starter apparatus comprising:

a starter motor;

a temperature sensor configured to detect a temperature of the starter motor;

a light source integrated with the starter motor; and a controller operatively connected to the temperature sensor and the light source, wherein the controller is configured to illuminate the light source in response to the temperature of the starter motor exceeding a first temperature threshold;

wherein the controller is configured to illuminate the light source further in response to the temperature of the starter motor exceeding a second temperature threshold, and the second temperature threshold is greater than the first temperature threshold;

wherein the controller is configured to:

illuminate the light source in a first color in response to the temperature of the starter motor exceeding the first temperature threshold; and illuminate the light source in a second color in response to the temperature of the starter motor exceeding the second temperature threshold, wherein the second color is different from the first color.

2. The engine starter apparatus of claim 1, wherein the second temperature threshold corresponds to a life limit of the starter motor.

3. The engine starter apparatus of claim 1, wherein the light source is mounted to a housing of the starter motor.

4. The engine starter apparatus of claim 1, wherein the light source is a light-emitting diode (LED).

5. The engine starter apparatus of claim 1, wherein the controller further comprises a memory configured to store the temperature of the starter motor.

6. The engine starter apparatus of claim 1, wherein the controller is wirelessly connected to a remote module configured to monitor and record the temperature of the starter motor.

7. A system for indicating an overheated engine starter, the system comprising:

a starter-motor housing;

a starter motor within the starter-motor housing; and a non-reversible temperature indicator mounted to the starter-motor housing such that the temperature indicator is visible from an exterior of the starter-motor housing, wherein the temperature indicator is configured to change states in response to a temperature of the starter motor exceeding a temperature threshold;

wherein the temperature indicator includes a substance configured to melt, break apart, or deform in response to the temperature of the starter motor exceeding the temperature threshold.

8. The system of claim 7, wherein the substance is configured to melt in response to the temperature of the starter motor exceeding the temperature threshold.

9. The system of claim 7, wherein the substance is configured to break apart in response to the temperature of the starter motor exceeding the temperature threshold.

10. The system of claim 7, wherein the substance is configured to deform in response to the temperature of the starter motor exceeding the temperature threshold.

11. An engine startup system comprising:

a starter motor configured to crank an engine and configured to be powered by an energy source;

a starter relay operatively interposed between the energy source and the starter motor and configured to selectively deliver electrical power from the energy source to the starter motor;

a solenoid coupled to the starter motor and configured to connect the starter motor to the energy source;

a temperature sensor configured to detect a temperature of the starter motor;

a light source integrated with the starter motor; and a controller operatively connected to the temperature sensor and the light source, wherein the controller is configured to illuminate the light source in response to the temperature of the starter motor exceeding a first temperature threshold;

wherein the controller is configured to illuminate the light source further in response to the temperature of the starter motor exceeding a second temperature threshold, and the second temperature threshold is greater than the first temperature threshold;

wherein the controller is configured to:

illuminate the light source in a first color in response to the temperature of the starter motor exceeding the first temperature threshold: and illuminate the light source in a second color in response to the temperature of the starter motor exceeding the second temperature threshold, wherein the second color is different from the first color.

12. The engine startup system of claim 11, wherein the energy source is a battery assembly.

13. The engine startup system of claim 11, wherein the second temperature threshold corresponds to a life limit of the starter motor.

14. The engine startup system of claim 11, wherein the light source is a light-emitting diode (LED).

15. The engine startup system of claim 11, wherein the controller further comprises a memory configured to store the temperature of the starter motor.

16. The engine startup system of claim 11, wherein the controller is wirelessly connected to a remote module configured to monitor and record the temperature of the starter motor.

* * * * *